United States Patent [19]

Fernandes

[11] Patent Number: 4,490,157

[45] Date of Patent: Dec. 25, 1984

[54] INDIRECTLY HEATED FLUIDIZED BED GASIFIER

[75] Inventor: John H. Fernandes, Windsor, Conn.

[73] Assignee: Combustion Engineering, Inc., Windsor, Conn.

[21] Appl. No.: 456,653

[22] Filed: Jan. 10, 1983

[51] Int. Cl.[3] ..... C10J 3/56; B01J 8/26

[52] U.S. Cl. ..... 48/62 R; 48/63; 48/73; 48/77; 110/245; 422/142; 422/145; 422/146; 431/7; 431/170

[58] Field of Search ..... 48/73, 63, 77, 202, 48/206, 197 R; 422/142, 145, 146; 110/229, 245, 263, 346, 347; 122/4 D; 165/104.16; 431/7, 170; 47/62 R

[56] References Cited

U.S. PATENT DOCUMENTS

| | | | |
|---|---|---|---|
| 2,527,197 | 10/1950 | Rollman | 48/206 |
| 3,279,887 | 10/1966 | Daniell et al. | 422/142 |
| 3,804,606 | 4/1974 | Archer et al. | 48/63 |
| 4,103,646 | 8/1978 | Yerushalmi et al. | 122/4 D |
| 4,115,070 | 9/1978 | Jukkola et al. | 422/145 |
| 4,303,023 | 12/1981 | Perkins et al. | 422/142 |
| 4,333,909 | 6/1982 | Stewart | 422/145 |
| 4,337,066 | 6/1982 | Kunii | 48/63 |
| 4,359,968 | 11/1982 | Stewart | 110/263 |
| 4,405,339 | 9/1983 | Kunii | 48/77 |

FOREIGN PATENT DOCUMENTS

| | | | |
|---|---|---|---|
| 2077615 | 12/1981 | United Kingdom | 165/104.16 |
| 2102694 | 2/1983 | United Kingdom | 48/77 |

*Primary Examiner*—S. Leon Bashore
*Assistant Examiner*—K. M. Hastings
*Attorney, Agent, or Firm*—Troxell K. Snyder

[57] ABSTRACT

A fluidized bed gasifier (10) for gasifying a first fuel (50) receives heat indirectly from a combusting fluidized bed (24) disposed at least partially within the gasifier fluidized bed (12). Fuel for the combusting bed (24) may be provided by removing a portion of the fluidized first fuel from the gasifier bed (12) and transporting (30,34) this removed portion into the combusting bed (12). Heat is transferred across the conductive walls of the combustor vessel (26). Product gas heating value is increased by separately removing (28) the products of combustion from the gasifier (10) and by recycling a portion of the product fuel gas (74) as the fluidizing gas (54) for the gasifier fluidized bed (12). A radiation shield (18) is also provided to reduce heat loss from the gasifier bed (12) and to remove elutriated material from the product fuel gas.

12 Claims, 6 Drawing Figures

INDIRECTLY HEATED FLUIDIZED BED GASIFIER

FIELD OF THE INVENTION

The present invention pertains to a method and an apparatus for gasifying a solid or liquid fuel and, more particularly, to a gasification method and apparatus wherein the solid or liquid fuel is gasified within a fluidized bed reactor and wherein the heat energy to drive the gasification reaction is supplied indirectly to the fluidized bed gasification reactor.

BACKGROUND OF THE INVENTION

Recent instabilities with regard to price and availability in the world oil market have provided an incentive for energy users to seek alternative fuel sources. One such alternative energy source results from the gasification of a solid carbonaceous fuel, such as coal, wood chips, oil shale, heavy oil, etc., for the production of a clean fuel gas which may be used for a wide variety of industrial and utility processes.

The gasification of a carbonaceous fuel is a relatively simple process, involving the reaction of carbon with water vapor to form carbon monoxide and hydrogen gas. As this reaction is endothermic, it is usually necessary to release at least a portion of the chemical energy of the solid fuel as heat energy by adding an excess amount of oxygen to the reactants. The excess oxygen allows combustion of at least a portion of the solid fuel within the gasification reactor thus releasing energy to drive the remaining gasification reactions. The resulting products of combustion, $CO_2$ and $H_2O$, dilute the produced fuel gas, thus reducing its heating value. If excess oxygen for the combustion reactions is supplied by using air, a quantity of inert nitrogen is also present within the produced fuel gas, reducing the heating value even further.

When certain fuels, such as coal, heavy oil, and waste hydrocarbons, are heated within a closed container a portion of the fuel is driven off as a gas. This process, know as devolatilization, results in the production of a hydrocarbon gas with a relatively high heating value, about 2670 to 4450 kcal/m$^3$ (300 to 500 BTU/cubic ft.). For carbonaceous fuels, the solid remaining after devolatilization is primarily carbon and any other inert compounds which may be present. This coke or char may be further gasified under the proper conditions of temperature and pressure by the addition of water vapor thus allowing the carbon-water gasification reaction to take place. The heat energy to drive the devolatilization and gasification reactions may be provided indirectly by means of heat transfer surface in contact with the solid fuel. Indirect gasification systems, although known in the prior art, have generally proved to be unsatisfactory due to their inability to effectively transfer heat from the heat source to the fuel and due to their inability to completely gasify all of the carbon in the remaining fuel solids.

Another drawback with prior art indirect processes results when sulfur is present within the feed fuel, as is often true with carbonaceous fuels such as coal. The sulfur reacts with available hydrogen to form hydrogen sulfide, $H_2S$, a noxious gas which, when combusted, forms sulfur dioxide, an atmospheric pollutant. Gasification systems in the prior art all remove the hydrogen sulfide produced in the gasification reaction by means of downstream scrubbing systems such as the Stretford or Selexol processes, both of which are complex and expensive undertakings.

A large number of industrial processes and equipment as well as certain large scale utility applications require a clean, sulfur-free fuel such as natural gas or highly refined oil. These processes could be easily adapted to use a clean fuel gas with a heating value in the range of 2670 to 4450 kcal/m$^3$ (300 to 500 BTU/ft$^3$). What is required is a simple, effective gasification system which produces a clean, relatively high energy content gas from an unsuitable carbonaceous fuel without the need for oxygen producing equipment and without leaving significant quantities of unreacted carbon. The clean fuel gas thus obtained, particularly that which results from the devolatilization process, is useful as a chemical feedstock for the production of certain plastics and other chemical products. The system should also be able to handle a wide variety of solid or liquid fuels and should efficiently utilize all of the heat energy available.

SUMMARY OF THE INVENTION

The present invention provides a method and an apparatus for producing fuel gas from a solid or liquid carbonaceous fuel, such as coal or heavy oil. According to the present invention, a first carbonaceous fuel is fluidized in a gasifier reactor fluidized bed. The gasifier fluidized bed is of the deep, high velocity variety providing intimate contact between the fluidized fuel and the fluidizing gas, as well as vigorous and continuous mixing of the fluidized matter.

Fuel gas is produced by heating the fluidized fuel to a temperature sufficient to drive off the volatile component of the fuel, and in the case of carbonaceous fuels and moisture-rich fluidizing gas, to encourage a carbon-water reaction. The products of the well known devolatilization and carbon-water reactions, primarily CO, $H_2$, and $CH_4$, are ducted away from the gasifier for cleanup and use.

Heat energy is supplied indirectly to the gasifier reactor fluidized bed by combusting a second fuel in a fluidized bed combustor which is at least partially disposed within the gasification reactor and which has thermally conductive walls located between the two fluidized beds for transferring heat energy. The flue gas from the combustor bed is conducted away from the gasification reactor and not permitted to mix with the product fuel gas.

Another feature of the present invention is the optional removal of a portion of the fluidized first fuel from the gasification reactor and the introduction of the removed first fuel into the combustor fluidized bed as the second fuel. The devolatilized solids in the removed first fuel still contain sufficient heating value to be useable as a fuel, and the combustor fluidized bed allows complete burnout of this removed fuel.

Still another feature, according to the present invention, is the optional use of recycled product gas as the fluidizing gas for the gasifier reactor fluidized bed. The use of a portion of the product gas in this way results in a high quality product gas, undiluted by nitrogen or other inert gaseous compounds.

The present invention also provides heat exchangers, disposed in the flue and product gas streams, for recuperative heat exchange with the respective combustor and gasifier fluidizing gas streams.

Still another feature of the apparatus according to the present invention is a radiation shield, disposed above the gasifier fluidized bed, for reducing the heat loss from the bed. The radiation shield also serves by design to remove a portion of the elutriated solids from the product gas stream and to return these solids to the gasifier reactor fluidized bed.

BRIEF DESCRIPTION OF THE DRAWING FIGURES

DESCRIPTION OF THE PREFERRED EMBODIMENT

Figure 2:
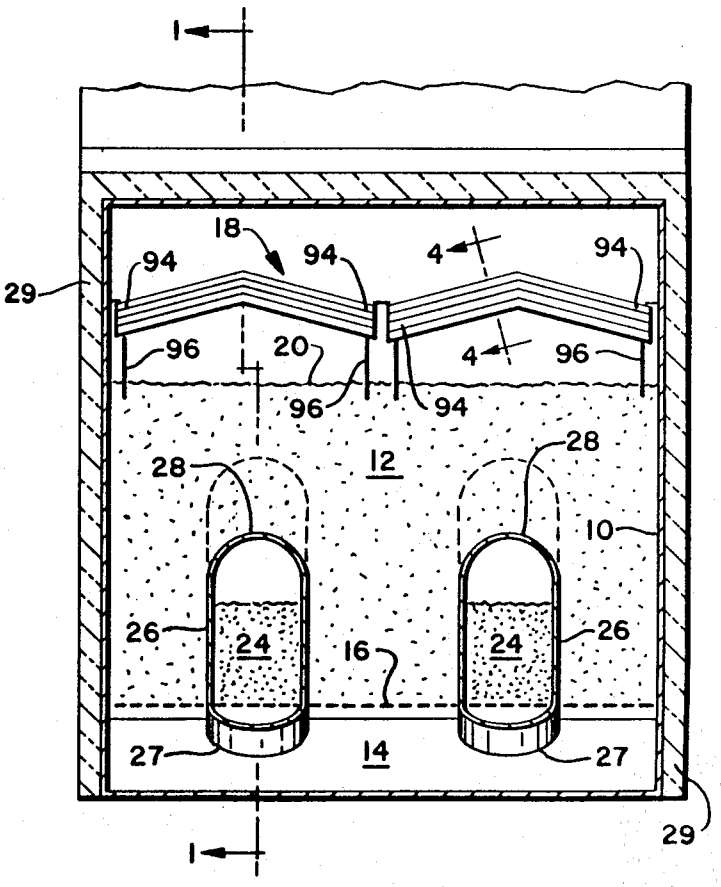
FIG. 2 is a sectional view of the apparatus as indicated on FIG. 1.
Figure 1:
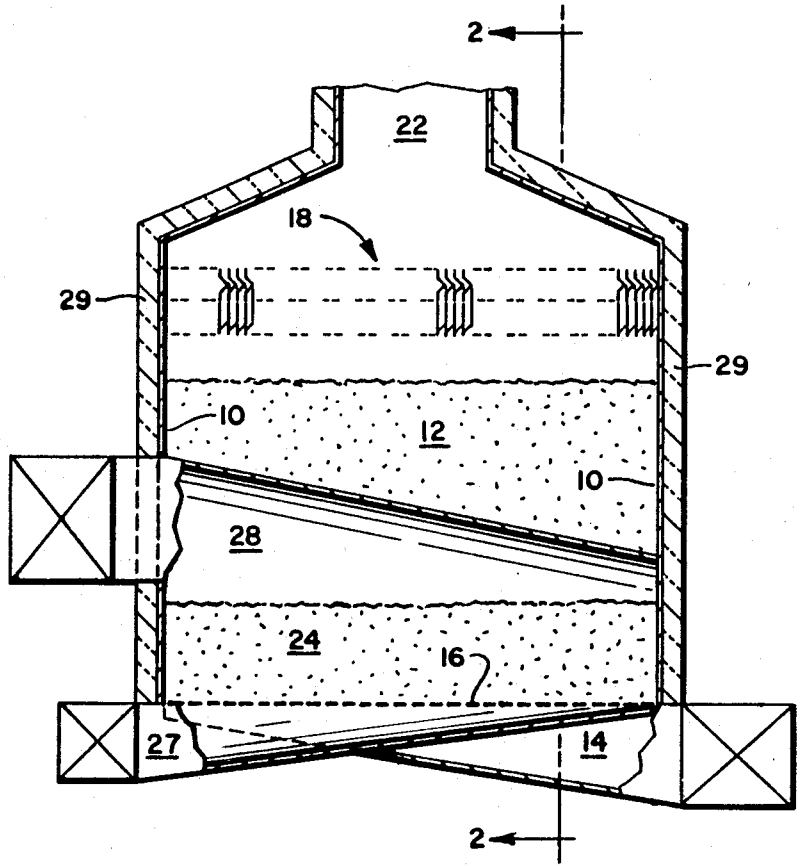
FIG. 1 is a sectional elevation view of the apparatus according to the present invention.

Referring now to FIGS. 1 and 2, the fluidized bed gasifier is shown generally as a vessel 10 containing the first fuel in a reactor fluidized bed 12. Fluidizing gas is supplied to the gasifier reactor fluidized bed 12 by a gas distribution means 14 such as the duct shown in FIG. 1 below the perforated plate 16. Gas enters the duct 14 and passes evenly through openings in the perforated plate 16 causing fluidization of the gasifier fluidized bed 12.

Product gas leaves the gasifier fluidized bed 12 at the upward surface of the bed 20, passes through the radiation shield 18 and leaves the gasifier vessel via exit duct 22. The velocity of the fluidizing gas through the gasifier fluidized bed is sufficient to cause complete fluidization of the bed 12 but not so great as to cause excessive elutriation of solid matter from the bed 12 into the exit duct 22.

Also shown in FIGS. 1 and 2 are combustor fluidized beds 24. The combustor beds 24 are shown enclosed within vessels 26 that are at least partially disposed within the gasifier fluidized bed 12. Combustion air is supplied through the portions of the perforated plate 16 beneath the beds 24 by an air distribution means 27.

The products of combustion from the combustor fluidized beds 24 are conducted out of the gasifier vessel 10 by the flue duct 28 as shown in the drawing figures. In this way the products of combustion are kept totally separate from the product gas, preventing dilution of the product gas.

During operation, a first carbonaceous fuel would be fed to the gasifier reactor fluidized bed 12. The fuel would be fluidized in the fluidizing gas stream and maintained in the temperature range of 871 to 899 C. (1600 F. to 1650 F.), thus causing devolatilization of the first fuel. This temperature range has been selected not only for the devolatilization reaction requirements, but also to prevent softening and agglomeration of any inert compounds which may be present in the first fuel. In addition to the devolatilization reaction within the gasifier reactor fluidized bed 12, it may also be advantageous to inject additional water vapor (not shown) into the fluidizing gas stream to encourage the carbon-water reaction, which is also favored at these temperatures.

The heat energy required to maintain the gasifier fluidized bed at this elevated temperature is supplied by the combustor fluidized bed. In the combustor fluidized bed 24, a second fuel is combusted in the presence of an oxidant such as air for the release of the chemical energy of the fuel as heat. In the preferred embodiment, the combustor has thermally conductive walls 26 and thermally conductive exit gas ducting 28 which is in intimate contact with the fluidized particles in the gasifier reactor fluidized bed 12. The heat energy released in the combustor fluidized bed 24 is conducted or radiated to the surrounding walls 26,28 and transferred into the gasifier reactor fluidized bed 12. Temperatures within the combustor fluidized bed are in excess of 982 C. (1800 F.) to provide a sufficient temperature differential across the conductive walls 26.

In order to minimize losses of heat energy from the gasifier reactor fluidized bed, the gasifier vessel 10 is insulated 29. Additionally, a radiation shield 18 is positioned above the surface 20 of the gasifier reactor fluidized bed 12. The radiation shield serves to intercept not only elutriated particles, but also radiant heat energy which may pass into the gas exit duct 22 and absorbed by any heat absorbing surface which may be disposed therein.

The relationship between particle size and superficial gas velocities in a fluidized bed reactor is well known in the art and will not be repeated here. Suffice to say that the gasifier and combustor fluidized beds are of the bubbling variety wherein vigorous mixing and substantial gas solid contact takes place. Material may be introduced or removed from the beds by any one of a number of means well known in the art for introducing and removing matter from similar fluidized bed reactors, although the preferred embodiment has a unique design configured particularly for the apparatus according to the present invention.

Figure 3:
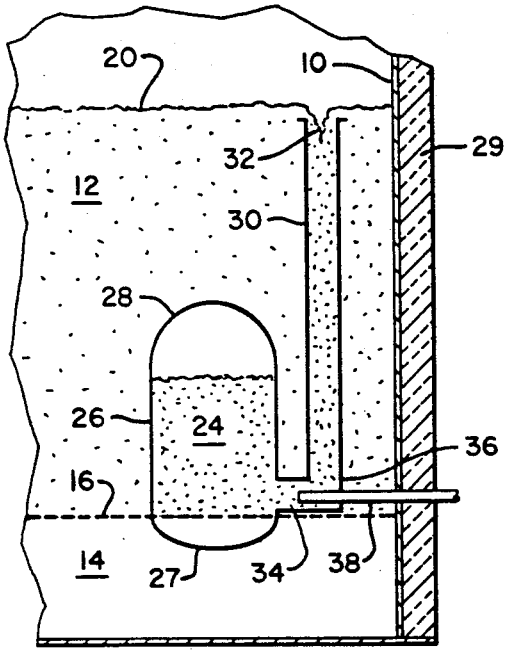
FIG. 3 is a more detailed representation of the means for transferring the first fuel from the gasifier reactor fluidized bed to the combustor fluidized bed.

This design is disclosed quite completely in FIG. 3. In this cross-sectional view of the gasification reactor 10 and the fluidized bed combustor 26, a substantially vertical conduit 30 is shown terminating at the upper end 32 just below the surface 20 of the gasifier reactor fluidized bed. During operation, a portion of the fluidized matter from the gasifier reactor fluidized bed 12 will enter the open end 32 of the conduit 30 and fall downwardly therethrough. A second conduit 34 is shown connected between the lower end 36 of the substantially vertical first conduit 30 and the combustor vessel 26. Material thus received into the vertical first tube 30 will be transferred into the combustor fluidized bed 24 by means of the second conduit 34. An optional gas jet 38 is shown within the second conduit and oriented to jet toward the combustor fluidized bed 24 for the purpose of urging the matter along the second conduit 34 into the combustor fluidized bed 24, if required. The gas jet 38 is connected to a source (not shown) of pressurized air, flue gas, or any other suitable gas which will interact with the matter in the second conduit 34.

The first fuel thus removed from the gasifier reactor fluidized bed 12 thus becomes the second fuel which is fed to the combustor fluidized bed 24. This transfer results in two advantages for the preferred embodiment of the present invention: first there is no need to obtain a second fuel for combustion within the combustor fluidized bed 24, and second the transfer allows the removal of devolatilized solids from the gasifier reactor fluidized bed 12 for the complete consumption of any chemical energy still remaining.

For a carbonaceous fuel with a volatile component and an inert ash component, such as coal or heavy oil, this system has particular advantages. The volatile component of the fuel is driven off by subjecting the fuel to a relatively high temperature environment. In the preferred embodiment according to the present invention, the carbonaceous feed would be devolatilized quickly upon entering the gasifier reactor fluidized bed 12, leaving primarily a solid particulate residue of carbon and ash constituents. This residue, know as char, is further reactable at the gasifier reactor fluidized bed temperature by introducing water vapor, if necessary, into the fluidizing gas to encourage the carbon-water reaction for the production of carbon monoxide and hydrogen gas, a comparatively slow chemical process when compared to the devolatilization reaction. By removing a portion of the fluidized carbonaceous residue from the gasifier reactor fluidized bed 12 and introducing this removed residue into the combustor fluidized bed 24, the necessary heat energy to drive the devolatilization and gasification reactions in the gasifier reactor fluidized bed 12 may be obtained.

While gasification of the char is a relatively slow process, the combustion of char proceeds rather quickly, due primarily to the abundance of oxygen present in the fluidizing gas and to the higher temperature levels involved. Shortly after entering the combustor fluidized bed 24, the char is completely reacted leaving only inert ash compounds in particulate form. The temperature level of the combustor fluidized bed must be maintained below the softening temperature of the inert ash compounds, typically 1482 to 1649 C. (2700 to 3000 F.), to prevent agglomeration of these compounds within the fluidized bed combustor 24. The ash compounds may be removed for disposal by any suitable removing means.

The apparatus for effecting this transfer of material between the gasifier reactor fluidized bed 12 and combustor fluidized bed 24 is particular advantageous when used in the preferred embodiment according to the present invention. The material entering the open end 32 of the vertical conduit 30 will fill the vertical conduit 30 in a slumped fashion, thus providing a resistance to gas flow between the combustor and the gasifier vessels. By carefully balancing the static pressure within each of these vessels the flow of oxygen into the gasifier or the flow of gas into the combustor may be eliminated. Furthermore, the disposition of the transfer conduits 30,34 wholly within the gasifier reactor fluidized bed 12 eliminates the heat loss which would be present in any transfer apparatus external to the fluidized beds 12,24.

Figure 4:
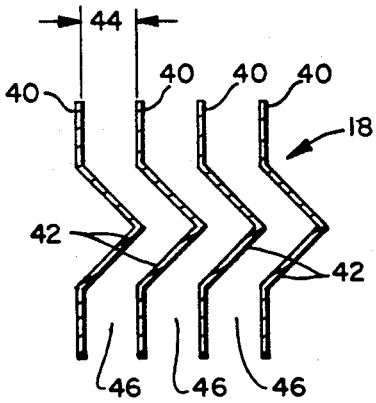
FIG. 4 is a cross-sectional view of the radiation shield as indicated on FIG. 2.

FIG. 4 shows a cross-sectional view of the radiation shield 18 shown in the previous drawing figures. The radiation shield consists of a plurality of elongated plates 40 each having a bent central portion 42 and each being spaced from the other at such a distance 44 to form a sinuous gas passage 46 between each pair of adjacent plates 40. Radiant heat energy from the surface 20 of the gasifier reactor fluidized bed 12 is unable to pass directly through the radiation shield 18 without first being absorbed and reradiated by the plates 40.

Figure 5:
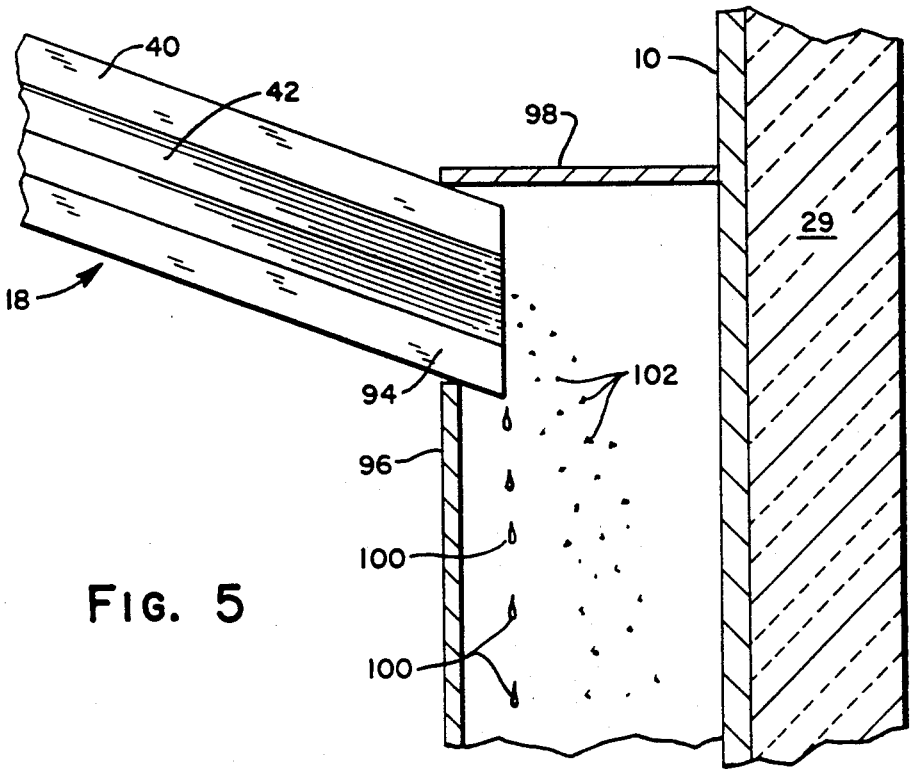
FIG. 5 is a detailed representation of the downcomer between the radiation shield and the gasifier reactor fluidized bed.

The radiation shield 18 also serves to help remove at least a portion of the tars, oils and particulate matters elutriated from the gasifier reactor fluidized bed 12. This elutriated material impinges on the bent portion 42 of the plate 40 and is disentrained from the product fuel gas. The disentrained material either falls directly back into the gasifier reactor fluidized bed 12, or moves down to the low points of the shield 94, entering downcomer conduit 96 for reintroduction into the gasifier bed 12 as shown in FIG. 5. The material in the downcomer 96 may be either oil drops 100 or particulates 102. A cap 98 is also shown at the upper end of the downcomer 96 to block bypassing of the radiation shield 18 by the product gas through the downcomer 96. This also reduces the possiblity of reentrainment of the removed matter 100,102.

With regard to the materials of construction, the gasification reactor 10 and the combustor vessel 26 may be constructed of any of a number of materials which possess sufficient strength and wearability at the expected temperature ranges. The combustor vessel walls 26 are subjected to the harshest environment in terms of high temperature and surface attack due to oxidation and reduction; but the process preferably takes place at pressures that are balanced between the combustor and the gasifier fluidized beds, thus reducing the physical stress on the combustor vessel walls 26. An exemplary, but not limiting, list of materials and techniques for user in this gasifier according to the present invention includes: high alloy stainless; high chromium, nickel steel; Inconel; a two-sided cermet with an oxidizing compound on one side and a reducing compound on the other; and a laminated ceramic with the same preferential resistance to surface attack. The exact choice depends, of course, on system design and economics.

Figure 6:
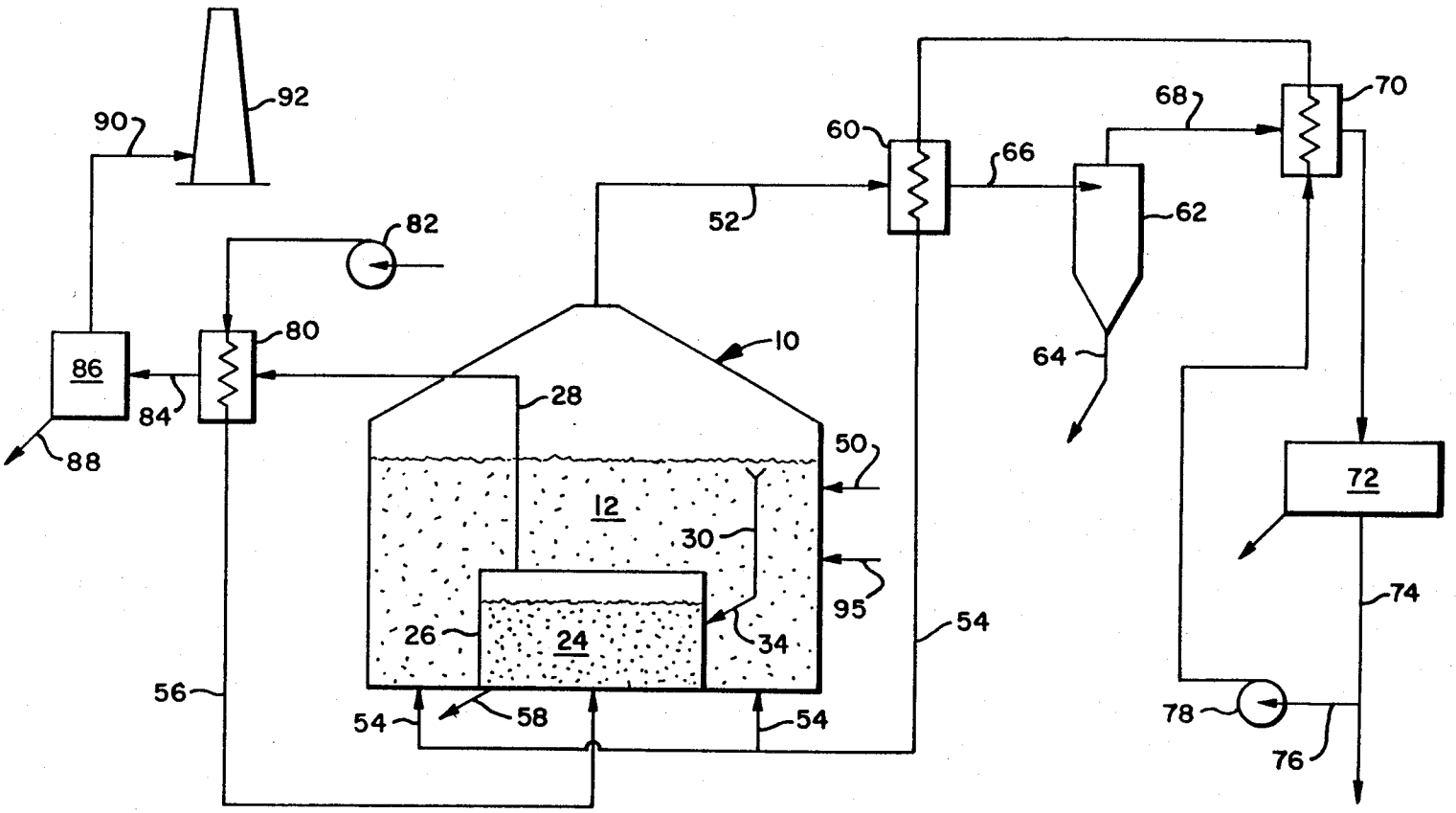
FIG. 6 is a schematic flow diagram of the method according to the present invention.

FIG. 6 is a general schematic showing the distribution of gas, air, and waste products which would be present in a full scale system according to the present invention. Again the gasifier vessel 10 is shown schematically having gasifier reactor fluidized bed 12 contained therein. The first fuel 50 is fed into the gasifier reactor fluidized bed 12 wherein it is devolatilized and gasified to form a raw product gas 52 shown exiting the upper portion of the gasifier vessel 10. The fluidizing gas 54 enters the lower portion of the reactor vessel 10 for causing the fluidization of the first fuel. The combustor vessel 26 is shown at least partially disposed within the gasifier reactor fluidized bed 12 and contains the combustor fluidized bed 24. Also indicated schematically is a means 28 for conducting the products of combustion from the combustor fluidized bed out of the gasifier vessel 10.

Combustion air 56 enters the lower portion of the combustor vessel 26 and provides the oxygen necessary for the combustion reaction. The second fuel for the combustor fluidized bed 24 is provided by removing a portion of the fluidized first fuel from the gasifier reactor fluidized bed 12 and conducting this removed fuel into the combustor fluidized bed 24 by transfer means 30,34. Stream 58 denotes the inert particulate matter removed from the combustor fluidized bed 24.

According to the present invention, the raw product gas 52 exiting the gasifier vessel 10 enters a first heat exchanger 60 for cooling prior to entering a particulate removal apparatus such as a cyclone 62. The particulate 64 removed from the partly cooled product gas stream 66 may be optionally returned to the gasifier, sent to the combustor, or otherwise disposed of. The mass flow rate to particulate matter 64 is relatively small but still may contain unburned carbon.

After the cyclone the relatively clean product gas 68 next enters another heat exchanger 70 for further cooling before entering the final particulate removal apparatus 72. This final particulate removal may be accomplished by a baghouse or a wet venturi scrubber. The particulate free gas 74 may be used for a wide variety of chemical feed stock or clean fuel applications.

One feature of the method according to the present invention involves the recycle of a portion of the cleaned product gas 74 back into the gasifier vessel as the fluidizing gas 54. As shown in drawing FIG. 5, a portion 76 of the product gas 74 enters the recycle gas fan 78 and is ducted back through the heat exchangers 70,60 which were used to cool the product gas. By reheating and recycling a portion of the cleaned product gas 74 into the gasifier vessel 10 as the fluidizing gas 54 of the gasifier reactor fluidized bed, product gas higher heating values of 2670 kcal/m$^3$ (300 BTU/ft$^3$) or higher may be maintained without the need for on site oxygen production as is required in certain methods of the prior art.

The method according to the present invention also provides, if necessary, the additional benefit of returning the moisture-laden product gas to the gasifier reactor fluidized bed 12 wherein the moisture may be used as a reactant in the carbon-water gasification reaction. Depending on the amount of moisture present in the gasification reactor, it may alternatively be necessary to reduce system moisture input to maintain conversion efficiency. This may be accomplished by drying the fuel or recycle product fuel gas by any of a number of well known drying processes.

As can be seen also from the drawing figure, the combustor receives air 56 which has been recuperatively heated in a heat exchanger 80 which is disposed in the flow path of the combustor flue duct 28. Air is supplied by the forced draft fan 82. The cooled flue gas 84 exiting the recuperative heat exchanger 80 enters a flue gas cleanup apparatus 86 for the removal of any particulate matter 88 which may be present within the exiting flue gas stream 84. After cleanup the flue gas 90 is sent to a stack 92 for release into the environment.

The method according to the present invention can also provide for the absorption or any sulfur which may be present within the first fuel feed 50 by means of the addition of a sulfur absorbent compound 95 to the gasifier reactor fluidized bed 12. The sulfur-absorbing compound, preferably a granulated calcium-bearing compound such as limestone, will absorb the sulfur present within the first fuel 50 during the gasification and devolatilization reactions that take place in the gasifier reactor fluidized bed 12. The sulfur-absorbing compound exits from the gasifier reactor fluidized bed 12 along with the absorbed sulfur by means of the transfer apparatus 30,34. The temperature of the combustor fluidized bed 24 must be maintained below that temperature which would cause the release of sulfur from the sulfur-absorbing compound, for calcium-bearing compounds no higher than approximately 1038 C. (1900 F.). The removed sulfur and spent sulfur absorbing compound exit the combustor fluidized bed along with the inert ash 54.

The present invention thus provides a method and an apparatus for efficiently and completely gasifying a carbonaceous fuel, such as coal, heavy oil or hydrocarbon wastes, while simultaneously absorbing any sulfur which may be present within this fuel. The clean product gas is suitable for a wide variety of chemical feed stock and fuel applications, particularly due to the high chemical energy content of the product gas. This high energy content is obtained without the use of an oxygen plant and without requiring the disposal of unreacted fuel solids. These and other advantages will be apparent to one skilled in the art upon review of the foregoing specification and the appended drawing figures and claims.

I claim:

1. An apparatus for gasifying a first carbonaceous fuel, comprising:

a fluidized bed gasification reactor for fluidizing said first fuel in a fluidizing gas stream;

a fluidized bed combustor, at least partially disposed within the gasification reactor, for combusting a second fuel and having thermally conductive walls for indirectly transferring heat energy from the combustor fluidized bed to the gasification reactor fluidized bed for causing the production of a fuel gas from the fluidized first fuel;

means for conducting the gaseous products of combustion away from the combustor;

means for conducting the product fuel gas away from the gasification reactor separate from the gaseous products of combustion;

means, disposed within the gasification reactor, for removing a portion of the fluidized first fuel from the gasification reactor, the removing means further comprising a substantially vertical first conduit openly terminating at the upper end below the surface of the gasification fluidized bed; and means for introducing the removed first fuel into the combustor as the second fuel, the introducing means further comprising a second conduit between the lower end of the first conduit and the fluidized bed combustor, whereby a portion of the fluidized first fuel in the gasification reactor enters the upper end of the first conduit, falls to the lower end thereof, and is conveyed into the combustor via the second conduit.

2. An apparatus for gasifying a first cabonaceous fuel, comprising:

a fluidized bed gasification reactor for fluidizing said first fuel in a fluidizing gas stream;

a fluidized bed combustor, at least partially disposed within the gasification reactor, for combusting a second fuel and having thermally conductive walls for indirectly transferring heat energy from the combustor fluidized bed to the gasification reactor fluidized bed for causing the production of a fuel gas from the fluidized first fuel:

means for conducting the gaseous products of combustion away from the combustor;

means for conducting the product fuel gas away from the gasification reactor separate from the gaseous products of combustion;

means for recycling a portion of the product fuel gas back the the gasification reactor as the fluidizing gas therefor;

means, disposed within the gasification reactor, for removing a portion of the fluidized first fuel from the gasification reactor, the removing means further comprising a substantially vertical first conduit openly terminating at the upper end below the surface of the gasification fluidized bed; and means for introducing the removed first fuel into the combustor as the second fuel, the introducing means further comprising a second conduit between the lower end of the first conduit and the fluidized bed combustor, whereby a portion of the fluidized first fuel in the gasification reactor enters the upper end of the first conduit, falls to the lower end thereof, and is conveyed into the combustor via the second conduit.

3. The apparatus of claim 2, wherein the second conduit further comprises a gas jet, disposed within the second conduit and oriented to jet towards the combustor fluidized bed, for uging the removed first fuel along the second conduit into the combustor fluidized bed.

4. The apparatus of claim 1, further comprising:

means, disposed in the flow stream of product fuel gas being conducted away from the gasification reactor fluidized bed, for removing heat energy from the product fuel gas; and means for transferring a portion of the heat energy removed from the product fuel gas into the gasification reactor fluidizing gas.

5. The apparatus of claim 2, further comprising:

means, disposed in the flow stream of product fuel gas being conducted away from the gasification reactor fluidized bed, for removing heat energy from the product fuel gas; and means for transferring a portion of the heat energy removed from the product fuel gas into the gasification reactor fluidizing gas.

6. The apparatus of claim 3, further comprising:

means, disposed in the flow stream of product fuel gas being conducted away from the gasification reactor fluidized bed, for removing heat energy from the product fuel gas; and means for transferring a portion of the heat energy removed from the product fuel gas into the gasification reactor fluidizing gas.

7. The apparatus of claim 4, further comprising a plurality of similarly bent plates disposed transversely above the gasification reactor fluidized bed across the flow stream of the product fuel gas, each plate being spaced sufficiently close to each adjacent plate for forming a plurality of sinuous gas passages for the product fuel gas and to form a radiation shield between the gasification reactor fluidized bed and the heat energy removing means.

8. The apparatus of claim 5, further comprising: a plurality of similarly bent plates disposed transversely above the gasification reactor fluidized bed across the flow stream of the product fuel gas, each plate being spaced sufficiently close to each adjacent plate for forming a plurality of sinuous gas passages for the product fuel gas and to form a radiation shield between the gasification reactor fluidized bed and the heat energy removing means.

9. The apparatus of claim 7, wherein said first fuel contains sulfur, further comprising means for feeding a sulfur absorbing compound into the gasification reactor fluidized bed for absorbing the sulfur present in said first fuel.

10. The apparatus of claim 8, wherein said first fuel contains sulfur, further comprising means for feeding a sulfur absorbing compound into the gasification reactor fluidized bed for absorbing the sulfur present in said first fuel.

11. The apparatus of claim 9, wherein the sulfur absorbing compound fed into the gasification reactor contains calcium, and the average temperature of the gasification fluidized bed is in the range of approximately 1600 to 1650 F.

12. The apparatus of claim 10, wherein the sulfur absorbing compound fed into the gasification reactor contains calcium, and the average temperature of the gasification fluidized bed is in the range of approximately 1600 to 1650 F.

* * * * *